US005414894A

United States Patent [19]

Fayngersh

[11] Patent Number: 5,414,894

[45] **Date of Patent: * May 16, 1995**

[54] DOOR CLOSER

[75] Inventor: Zakhary Fayngersh, West Hartford, Conn.

[73] Assignee: Corbin Russwin, Inc., Berlin, Conn.

[ * ] Notice: The portion of the term of this patent subsequent to Nov. 9, 2010 has been disclaimed.

[21] Appl. No.: 130,251

[22] Filed: Oct. 1, 1993

Related U.S. Application Data

[63] Continuation of Ser. No. 738,636, Jul. 31, 1991, Pat. No. 5,259,090.

[51] Int. Cl.[6] ..... E05F 3/10

[52] U.S. Cl. ..... 16/52

[58] Field of Search ..... 16/51, 52, 62, DIG. 21

*Primary Examiner*—P. Austin Bradley
*Assistant Examiner*—Chuck Y. Mah
*Attorney, Agent, or Firm*—Darby & Darby

[57] ABSTRACT

A door closer (20) is attachable to a door (24) and is formed with a chamber (44) in which a piston element (50) is movable to move fluid from the chamber to a reservoir (82) upon opening of the door. After the door (24) has been opened to a position, for example, of sixty to seventy-five degrees, continued opening of the door causes the fluid to be compressed within the chamber (44) and to be directed only through a back check valve (95) to the reservoir (82). This results in the development of an adjustable "back check" condition to provide a counterforce to the continued opening of the door. The adjustable valve (95) includes a spring biased ball (144), the biasing of which must be overcome by the force of the fluid being compressed in the chamber (44) to allow for fluid to pass through the valve to the reservoir (82).

The chamber (44) is formed partially by a spring tube (38) having slots (192) formed in the interior wall thereof which extends radially beyond convolutions of spring (52) contained within the tube. The slots (192) allow the fluid, and gas bubbles entrapped therein, to be moved beyond the convolutions of the spring (52) and to be moved unimpeded into the reservoir (82). Otherwise, the gas bubbles would be trapped in the chamber (44) and would deleteriously affect the operation of the door closer (20).

4 Claims, 5 Drawing Sheets

DOOR CLOSER this is a continuation of application Ser. No. 07/738,636, filed on Jul. 31, 1991, now U.S. Pat. No. 5,259,090.

BACKGROUND OF THE INVENTION

This invention relates to a door closer and particularly relates to a door closer with a back check adjustment and further relates to a door closer with facility for extracting a gaseous medium from a fluid used in the operation of the door closer.

Door closers typically are formed by a cylinder which is coupled to a spring tube to form an enclosed main chamber containing fluid (e.g. oil) within the cylinder and tube. A piston is located within the cylinder for movement within the chamber. At least one coil spring is located within the tube portion of the chamber and is in axial engagement with one end of the piston to normally urge the piston into the cylinder portion of the chamber when the associated door is closed.

An elongated opening is formed through the piston and extends from near one end of the piston to near the other end thereof. One side wall of the elongated opening is formed with teeth to form a rack. A pinion is located within the elongated opening so that the teeth of the pinion mesh with the teeth of the rack.

Driving elements are formed on opposite sides of the pinion and extend through the sidewall of the cylinder to allow coupling of the driving elements and the pinion to facilities external of the cylinder.

A door closer of this type can be mounted on one surface of a door near the top where one of the driving elements is coupled to one end of a first linkage arm. The other end of the first arm is coupled to one end of a second linkage arm for hinged movement relative thereto while the other end of the second arm is coupled for pivotal movement to a bracket which is fixedly secured to the door frame.

When the door is in the closed position, the linkage arms are positioned so that the spring is urging the piston into the end of the cylinder portion of the chamber which is furthest from the spring tube. As the door is opened, the linkage arms are moved so that the first arm causes the driving element and pinion to rotate about the axis of the pinion. As the pinion rotates, the mesh of the pinion and rack teeth cause the piston to move against the biasing action of the spring and toward the tube portion of the chamber.

A reserve chamber or reservoir is formed in the cylinder and communicates with the main chamber through a main passageway and a back-check passageway of restricted opening formed in the cylinder wall. As the piston is moved upon opening of the door, some of the fluid is initially urged from the main chamber through the main passageway and the back-check passageway of restricted opening and into the reservoir. Eventually, the piston is moved sufficiently to cover the main passageway whereby the fluid now travels only through the back-check passageway into the reservoir. This condition occurs, for example, when the door is opened about sixty to seventy-five degrees from a closed position. The fluid now begins to be compressed within the main chamber with the only outlet being through the back-check passageway and thereby provides a "back check" condition to prevent the door from being swung open too swiftly.

A back-check valve is located in the back-check passageway and allows for adjustment of the restricted opening of the passageway to control the volume of fluid allowed to pass to the reservoir during a given period. Thus, for doors that are opened in a normal manner, the "back check" adjustment permits the user to establish the degree to which the movement of the door will create a counterforce in opposition to further movement of the door beyond the position of the sixty to seventy- five degrees opening. This protects the door, the surrounding door support structure, the person opening the door and anyone in the path of the door being opened. However, if the door is opened in a violent or swift manner, the fluid still can only pass through the back check valve at a rate determined by the manually adjusted setting. In this situation, the fluid cannot pass quickly enough into the reservoir and is suddenly compressed within the main chamber to develop a significant back pressure. In response to the continued violent force of opening the door, the door could be violently separated from the frame causing serious damage to the door and support structure and serious injury to anyone in the area of the door including the person opening the door.

The typical back-check valve includes a threaded plunger with a slightly tapered tip which can be adjustably positioned adjacent a port associated with the back-check passageway. In this manner, as the plunger is adjusted inwardly, more of the port is covered to effectively control the rate of the fluid allowed to pass therethrough.

As long as the door closer operates in a consistent temperature environment, the back-check valve can be adjusted to a desired position and the position of the door at which the "back check" condition will occur at all times is generally at the same degrees opening and resistance. However, most doors are located in an environment which has considerable temperature swings as the seasons of the year pass as well as for other reasons. Under these changing-temperature conditions, the viscosity of the fluid changes to the extent that the "back check" condition will change so that the resistance will be at an undesirable level.

Thus, there is a need for a back-check valve which will respond to the force of opening the door, whether such opening be in a normal fashion with a moderate force or in a violent manner with an exceptional force, and allow for the development of sufficient counterforce in the establishment of the "back-check" condition. Further, there is a need for a back-check valve which will allow for the development of sufficient counterforce in the establishment of the "back-check" condition regardless generally of the temperature of the environment in which the door closer operates.

In the typical door closer described above, it is desired that any air or gases entrapped within the fluid and located within the tube portion of the main chamber will be "worked" into the reservoir as the fluid is moved through the passageways to the reservoir. Since air is an easily compressible medium, in comparison to a fluid such as oil, too much air in the main chamber will permit continued, relatively free movement of the door past the sixty to seventy-five degrees opening and lessen the desired effect of the "back check" condition. Therefore, it is desirable to move the air from the main chamber and into the reservoir as the piston is moved upon opening of the door as quickly as possible. However, the portion of the fluid which contains the entrapped air must have an essentially unobstructed path through the main chamber to the reservoir.

Typically, the reservoir is located at the side and extends from the top to the bottom of the cylinder and the air entrapped within the fluid will "work" its way to the upper portions of the fluid at the top of the chamber. As the piston is moved as noted above, the fluid is moved from the main chamber, through the passageways and into the reservoir. However, significant portions of the entrapped air will rise to the top of the tube portion of the chamber and will be further captured between the upper portions of the convolutions of the coil spring within the spring tube. As the fluid is moved through the passageways, the portions of the fluid between the upper portions of the convolutions of the spring will not move and the air entrapped therein also will not move. Thus, some of the more easily compressible air remains in the main chamber and deleteriously affects the operation of the door closer as noted above.

Thus, there is a need for a door closer which will avoid the entrapment of air within the fluid at the top of the main chamber and will allow the air to move desirably from the main chamber into the reservoir.

SUMMARY OF THE INVENTION

It is, therefore, an object of this invention to provide a door closer including a back check valve which allows for the development of sufficient counterforce to the opening of a door to which the door closer is attached and the establishment of a "back-check" condition regardless of the speed of force applied in opening the door and regardless of the temperature of the environment in which the door closer is operating.

Another object of this invention is to provide a door closer which allows gas entrapped in a fluid of the door closer to be "worked" out of a main fluid chamber so that compressed fluid within the chamber provides for the "back check" condition at the desired location of the door being opened.

With these and other objects in mind, this invention contemplates a door closer which includes a housing having a chamber formed therein for containing a fluid within the chamber. A piston element is located normally within a first portion of the chamber and is movable within the chamber. Means, responsive to external forces, are provided for moving the piston element into a second portion of the chamber to initiate compression of the fluid therein. At least one passageway is formed in the housing in communication with the second portion of the chamber to allow at least portions of the compressing fluid to be moved out of the chamber and through the passageway upon movement of the piston element into the second portion of the chamber. Means, located in the passageway and responsive to the pressure of the fluid being moved therethrough, are provided for controlling the rate of flow of the fluid through the passageway and, thereby, the rate of permissible movement of the piston element within the chamber.

This invention further contemplates a door closer which includes a housing having a chamber formed therein for containing a fluid within the chamber. A piston element is located normally within a first portion of the chamber and is movable within the chamber. Means, responsive to external forces, are provided for moving the piston element into a second portion of the chamber to initiate compression of the fluid therein. Means are formed in the housing and in communication with the chamber for allowing gases entrapped within the compressing fluid to be moved out of the chamber.

Other objects, features and advantages of the present invention will become more fully apparent from the following detailed description of the preferred embodiments, the appended claims and the accompanying drawings.

DETAILED DESCRIPTION OF THE PREFERRED EMBODIMENTS

Figure 1:
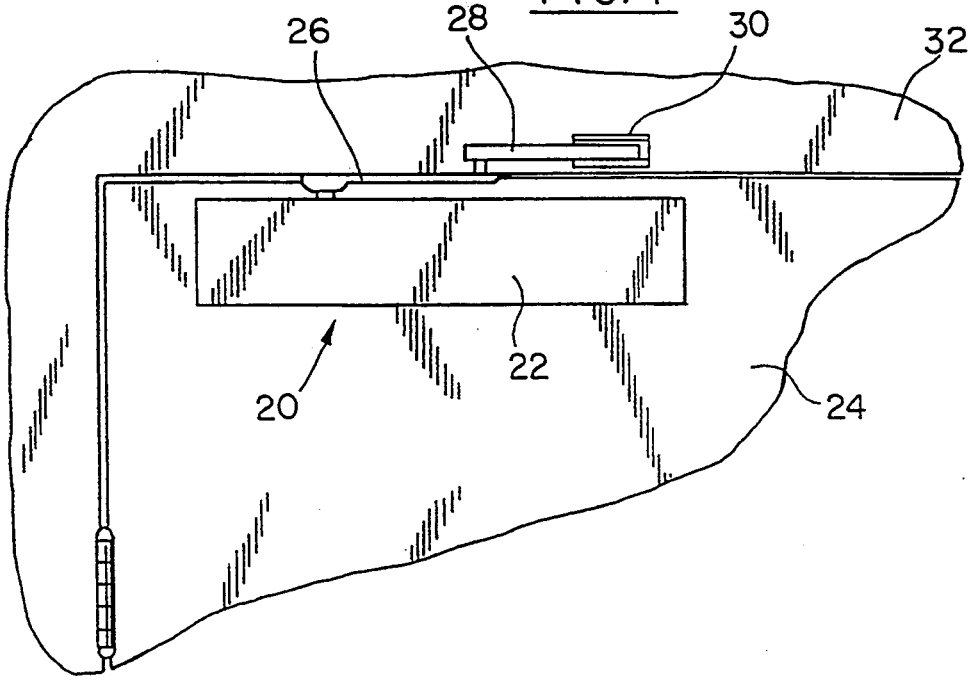
FIG. 1 is a partial front view showing a door closer in assembly with a door and related door frame.
Figure 2:
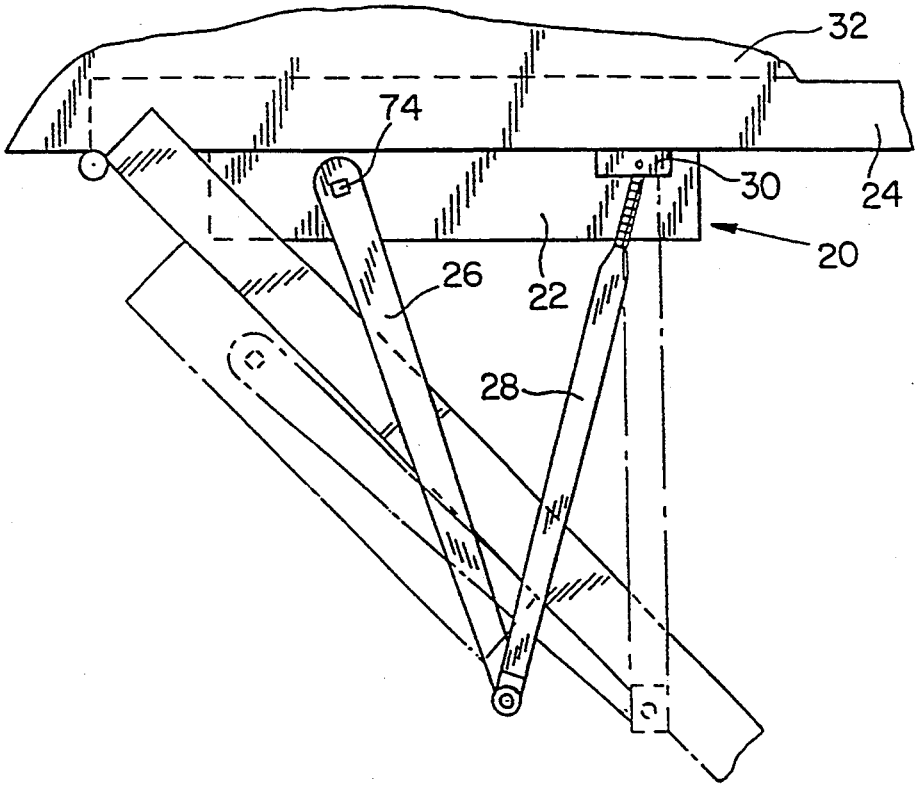
FIG. 2 is a top view of the door closer of FIG. 1 showing the door in a closed position and in an open position.
Figure 3:
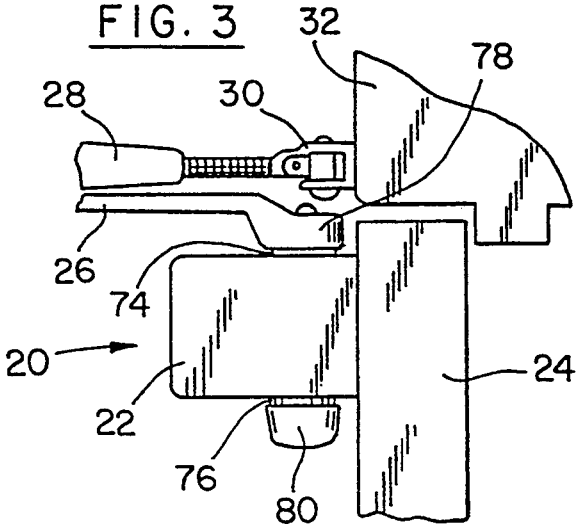
FIG. 3 is a side view showing the door closer of FIG. 1 in assembly with the door and related door frame.

Referring to FIGS. 1, 2 and 3, one preferred embodiment of the invention includes a door closer 20 which is enclosed within a cover 22 and is typically mounted to the upper surface of a door 24 such as a heavy duty door. One end of a first actuator arm 26 is coupled for pivoting movement to door closer 20 and is connected for pivoting movement to a second actuator arm 28. The other end of arm 28 is connected for pivoting movement to a bracket 30 which is mounted on a door frame 32 associated with door 24.

Referring to FIG. 2, as door 24 is opened, or closed, arm 28 is pivoted with respect to bracket 30 and results in pivoting movement of arm 26 which is coupled to door closer 20. As door 24 is opened, a mechanism within door closer 20 is operated to provide opposition to the rapid opening of the door and eventually to provide a back pressure when the door reaches, for example, an opening of sixty to seventy-five degrees. It then becomes increasingly more difficult to open the door to a full open position. In effect, then, door closer 20 provides a back pressure as the door is opened to these positions to establish a "back check" condition as if there was a physical impediment in the path of the door which must be overcome to open the door further. This feature is useful, for example, where heavy doors are used and where the rapid opening of such doors could result in serious injury to anyone near the opening side of the door or could result in serious and costly damage to the door and surrounding structure.

Figures 4, 5, 6:
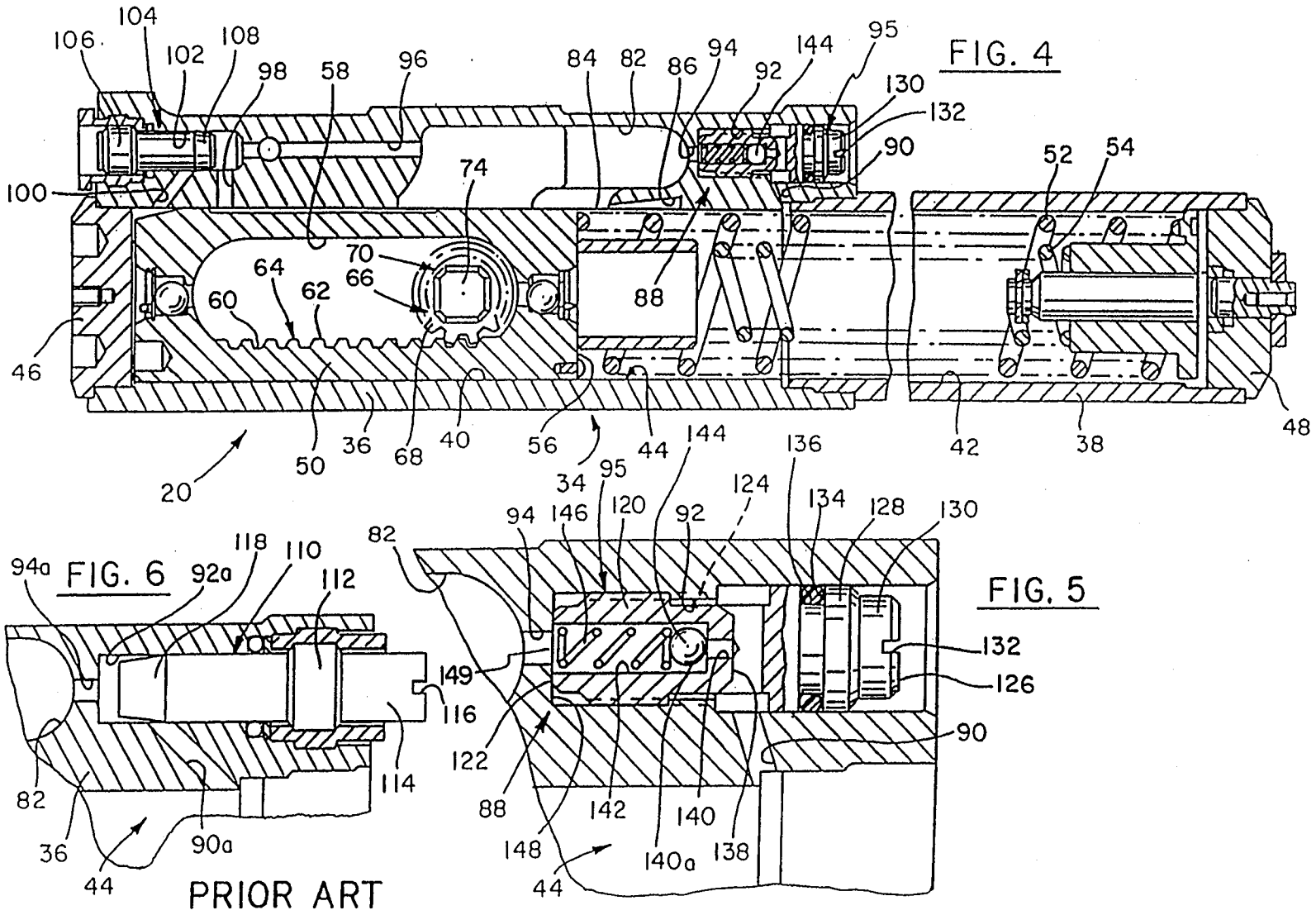
FIG. 6 PRIOR ART
FIG. 4 is a sectional view of a door closer embodying certain principles of the invention.
FIG. 5 is an enlarged sectional view of a portion of the door closer of FIG. 4 further showing features embodying certain principles of the invention.
FIG. 6 is a partial sectional view showing a valve arrangement in a prior door closer for adjusting the back pressure provided by the door closer.

As shown in FIG. 4, one of the preferred embodiments of the invention includes the door closer 20 with a housing 34 formed by a cylinder 36 and a spring tube 38 threadedly joined together. Cylinder 36 and spring tube 38 are assembled together in axial alignment so that a cylinder opening 40 and a tube opening 42, respectively, join to form a chamber 44. A first cap 46 is located over one end of cylinder 36 and a second cap 48 is located over one end of spring tube 38 to enclose chamber 44 between the caps.

A piston element 50 is located normally in a first portion of chamber 44 generally defined by about two-thirds of opening 40 of cylinder 36. A pair of compression springs 52 and 54 are captured within chamber 44 between an inward end 56 of the piston element 50 and the tube cap 48. Springs 52 and 54 are located in a second portion of chamber 44 defined by the remaining one-third of cylinder opening 40 and all of tube opening 42. Further, the second portion of chamber 44 which includes springs 52 and 54 is typically filled with a fluid such as, for example, oil which is not readily compressible.

Piston element 50 is formed with an elongated opening 58 which is enclosed at the axial ends thereof but is open from side to side. An elongated wall 60 of opening 58 is formed with teeth 62 which extend inwardly of the opening to form a rack 64. A driving pinion 66 having teeth 68 about the periphery thereof is located within opening 58 at one end thereof as illustrated in FIG. 4 with the teeth of the pinion being in mesh engagement with the teeth 62 of rack 64. A pair of coupling elements 70 and 72 (FIG.8) which are capped by square heads 74 and 76 (FIG. 8), respectively, are formed integrally with pinion 64 and extend axially from opposite sides thereof to locations externally of cylinder 36.

Referring to FIG. 3, a hub end 78 of arm 26 is located over square head 74 for driving connection therewith. In this arrangement, square head 76, which is not used, is covered by protective cap 80.

Referring again to FIG. 4, a reservoir 82 is formed at the side and extends from the top to the bottom of cylinder 36 and communicates with chamber 44 through an opening 84. Further, a bevelled slot 86 is formed in cylinder 36 to provide another path of communication between chamber 44 '12 reservoir 82 through opening 84. As viewed in FIGS. 4 and 5, a passageway 88 is formed in cylinder 36 for providing another path of communication between chamber 44 and reservoir 82 and includes a flow passage 90, a valve chamber 92 and a flow passage 94. A valve 95 embodying certain principles of the invention is threadedly located within valve chamber 92 the axis of which is parallel to the longitudinal axis of cylinder 36.

Referring again to FIG. 4, other flow passages 96, 98 and 100 are formed in conjunction with a valve chamber 102 to provide still another communication passageway between chamber 44 and reservoir 82. A threaded valve 104 is located in valve chamber 102 and is formed with a slotted head 106 at one end and a tapered portion 108 at the other end. Valve 104 can be adjusted threadedly within chamber 102 to position the valve and the tapered portion 108 thereof to control the flow rate of the fluid through passages 98 and 100, valve chamber 102, passage 96 and into reservoir 82. A valving arrangement such as that which includes valve 104 is used to control the allowable speed of door closing at the time of latching.

Referring now to FIG. 6, a portion of cylinder 36 is illustrated to show a back-check valve 110 of the type used in the past for adjustment of the flow rate of the fluid from chamber 44 into reservoir 82 to establish the "back-check" condition. In particular, valve 110 is formed with a threaded body 112 which facilitates the threaded mounting of the valve within a valve chamber 92*a*. An accessible end 114 of valve 110 is formed with a slot 116 to facilitate threaded adjustment of the valve within chamber 92*a*. The forward end of valve 110 is formed with a tapered portion 118 which is positionable adjacent an exit end of passage 90*a* to control the rate of flow of the fluid.

Typically, in the use of door closer 20 which includes valve 110, the valve is threadedly adjusted to selectively position tapered portion 118 adjacent passage 90*a*. When door 24 is opened, piston element 50 is moved to the right as viewed in FIG. 4 whereby some of the fluid in chamber 44 initially flows relatively rapidly into reservoir 82 through opening 84, slot 86 and chamber 92*a* as well as through passages 90*a* and 94*a*. During this period of rapid fluid flow into reservoir 82, door 24 encounters only the back pressure developed by springs 52 and 54 whereby the door opens with only moderate opposition. The positioning of tapered portion 118 of valve 110 adjacent the exit end of passage 90*a* determines the amount of fluid allowed to pass through chamber 92*a* for a given period and thereby establishes the rate of fluid flow through the chamber. In particular, as illustrated in FIG. 6, tapered portion 118 is located sufficiently close to the exit end of passage 90*a* to allow a very small amount of fluid to flow through chamber 92*a* to reservoir 82 which tends to develop significant back pressure to the rightward movement of piston element 50 (FIG. 4). However, as long as piston element 50 has not passed, and thereby has not covered, opening 84 and slot 86, the fluid moves rapidly into reservoir 82 and door 24 continues to be opened with only moderate opposition.

Eventually the door reaches an opening at an angle within a range about sixty to seventy-five degrees from the closed position. At this time, piston element 50 has reached and now covers opening 84 and slot 86. For the fluid to continue to flow into reservoir 82, it now passes only through chamber 92*a* where tapered portion 118 of valve 110 significantly restricts such fluid flow as noted above. At this time, the "back check" condition occurs resulting in the development of a significantly high level of back pressure due to the constricted flow of fluid through chamber 92*a*. This back pressure applies significant opposition to the continued opening of door 24. Thus, while door 24 can be opened further beyond the occurrence of the "back check" condition, it is significantly more difficult to do So. The "back check" condition thereby prevents rapid opening of the door which rapid opening could be harmful to anyone on the opening side of the door or it could damage the adjacent structure.

If valve 110 is adjusted to the desired position and someone opens door 24 violently, piston element 50 will quickly pass by opening 84 and slot 86 to preclude the relatively easy flow of fluid from chamber 44 into reservoir 82. Thereafter, the fluid must flow through the small constriction of valve 110 at the rate established by the adjusted opening of the valve regardless of the rapid compression of the fluid within chamber 44. With continued violent opening of door 24, the compression force applied to the fluid in chamber 44 by piston element 50 quickly reaches a relatively high level. At this high level of compression force, the fluid cannot be moved quickly enough through the fixed constriction setting of valve 110 to relieve the rapidly building compression force within chamber 44. With such pent-up pressure within chamber 44, the counterforce in opposition to the continued violent opening of door 24 results in damage to the door and the surrounding structure such as, for example, the door being forced from its hinged mounting to door frame 32. Such a violent reaction could also result in injury to the person opening door 24 or anyone located in the vicinity of the door.

Thus, there is a need for a back check valve which will respond to the opening of door 24, regardless of the level of door-opening force and the speed at which it is applied, and thereafter allow the development of the "back check" condition.

In another consideration of the use of valve 110, the valve is adjusted to the desired position as noted above and, desirably, would not have to be readjusted during subsequent use of the door. However, the fluid used in door closer 20 is usually of the type which is affected by changes in the temperature of the environment immediately surrounding the door closer. For example, as the temperature drops, the fluid thickens and, for a given force, moves at a comparatively slower pace. This makes it more difficult, during the door-opening process, for the fluid to be moved through the restricted portion of chamber 92*a* in the area of tapered portion 118 of valve 110 and the exit opening of passage 90 thereby resulting in greater opposition to the opening of door 24.

On the other hand, if the temperature rises, the fluid thins to the extent that it can be moved more freely during the door-opening process even though it still must flow through the restricted portion of chamber 92*a*. This results in less opposition to the opening of door 24.

Consequently, with wide swings in the temperature surrounding door closer 20, comparably wide swings in the "back check" opposition to opening of the door are encountered for a given setting of back check valve 110. If some uniformity in developed back pressure is to be maintained, back check valve 110 must be adjusted frequently with changes in temperature.

Thus, there is a need for a back check valve which is much less sensitive to temperature swings.

Referring now to FIGS. 4 and 5, back check valve 95, which illustrates one preferred embodiment of the invention, includes a threaded portion 120 at one end 122 thereof which is threadedly positionable within a threaded portion 124 of valve chamber 92. Another end 126 of valve 95 is formed with a slide portion 128 and an external head 130 with a slot 132 to facilitate threaded mounting of the valve within chamber 92. Slide portion 128 is formed with an annular groove 134 and receives a pliable "O" ring 136. Back check valve 95 is also formed with a transverse passage 138, axial passage 140 and chamber 142. Passage 138 is in communication with passage 140 which, in turn, is in communication with chamber 142. A spherical member or ball 144 is positioned within chamber 142 adjacent to port 140*a* associated with passage 140 and is normally held in this position by a compression spring 146 after valve 95 has been threadedly seated in chamber 92 as illustrated in FIGS. 4 and 5. Literally, then, ball 144 closes port 140*a* until the ball is urged toward the other end of chamber 92 against the biasing action of spring 146.

In use, valve 95 is threadedly mounted into chamber 92 as illustrated in FIGS. 4 and 5. In this position, the tail portion of compression spring 146 is resting against end wall 148 of chamber 92 adjacent a port 149 formed in the end wall and located at the juncture of flow passage 94 and chamber 142, to apply a compressing force against ball 144. This action urges ball 144 into blocking position over port 140*a*.

The compression force applied by spring 146 against ball 144 can be adjusted as desired by the location of valve 95 within chamber 92. This will establish the level of force of the fluid as applied against ball 144 at port 140*a* necessary to overcome the force of spring 146 to thereby allow the ball to be moved from the port and fluid to pass through the port. For example, as illustrated in FIGS. 4 and 5, valve 95 is assembled fully within chamber 92 so that valve end 122 seats against end wall 148 of chamber 92. In this position, spring 146 is compressed to the maximum level and thereby applies the maximum force possible to hold ball 144 over port 140*a*. The force of the fluid being compressed in chamber 44 must exceed the level of force applied to ball 144 by spring 146 to cause the ball to be moved from port 140*a*.

If valve 95 is adjusted so that valve end 122 is not in engagement with chamber wall 148, spring 146 expands and is relaxed in comparison to the maximum available compression described above. In the relaxed condition, the force applied by spring 146 against ball 144 is less than the maximum force noted above. Thus, the force of the fluid against ball 144 required to overcome the force applied by relaxed spring 146 is less than the force of the fluid noted above when the spring was in the maximum force condition.

With this flexibility, the arrangement of ball 144 and spring 146 with valve 95 permits adjustment of the valve to many selectable positions to develop the desired level of force which the compressing fluid must present in the establishment of the "back-check" condition.

When valve 95 is mounted within chamber 92 as illustrated in FIGS. 4 and 5, transverse passage 138 of the valve is in communication with passage 90 of cylinder 36 while chamber 142 of the valve is aligned and in communication with passage 94 of the cylinder.

As piston element 50 is moved to the right (FIG. 4) upon the opening of door 24, fluid is moved through passage 90, into passage 138 and further into passage 140. The force of the fluid upon ball 144 will attempt to move the ball against the biasing action of spring 146. Also, "O" ring 136 forms a seal against the wall of chamber 92 to preclude any fluid from leaking toward the open end of the chamber adjacent head 130. If piston element 50 has not been moved past opening 84 and slot 86, door 24 is being opened with only moderate opposition offered mainly by springs 52 and 54. In this mode, the force of the fluid against ball 144 is not sufficient to move the ball slightly away from port 140*a* to allow fluid to flow into chamber 142 and eventually through passage 94 into reservoir 82. Again, since piston element 50 has not been moved past opening 84 and slot 86, door 24 continues to be moved with only moderate opposition. Therefore, valve 95 plays no role in offering opposition to the opening of door 24 at this time.

Eventually, door 24 is opened to the sixty to seventy-five percent position and opening 84 and slot 86 are covered by piston element 50 in the manner described above. At this time, any fluid which will flow into reservoir 82 must pass through passages 90, 138 and 140, chamber 142 and passage 94. In order for fluid to pass from passage 140 into chamber 142, the force and pressure of the fluid being compressed by movement of piston element 50 to the right (FIG. 4) must move ball 144 away from port 140*a*. The level of force of the fluid as applied against ball 144 moves the ball against the biasing action of spring 146 and thereby overcomes, partially, the compressing force of the spring. As ball 144 is moved away from port 140*a*, fluid is then allowed to be moved from passage 140 into chamber 142 and eventually into reservoir 82.

Thus, valve 95 is directly responsive to the compressing force being developed by the compression of fluid within chamber 44 upon movement of piston element 50 into the chamber. If door 24 is being opened in a normal manner with moderate force, piston element 50 will move at a pace which allows some of the fluid to move through opening 84 and slot 86 into reservoir 82. Thereafter, the continued application of a moderate force in opening door 24 results in compressing of the fluid within chamber 44. This causes a moderate compression force to be applied against ball 144 to move the ball as noted above a distance away from port 140*a* determined by the instantaneous compression force and the biasing force of compression spring 146. In any event, the opening provided by the space between ball 144 and port 140*a* is sufficient to allow fluid to flow through valve 95 at a rate commensurate with the level of compression force within chamber 44 required to establish the "back check" condition.

In the event that door 24 is opened in a violent manner, piston element 50 quickly passes by opening 84 and slot 86 and begins to compress the fluid within chamber 44. As the compression force builds rapidly, a force is applied against ball 144 to move the ball from port 140*a*. The compression force developed under the violent-opening condition is much higher than the compression force of the normal opening as described above. In the instance of the violent opening, the force upon ball 144 is significantly greater than the normal-opening force and the ball is moved a greater distance from port 140*a* and thereby allows a higher rate of fluid flow through valve 95. Thus, even though the fluid is being compressed at an extremely rapid rate within chamber 44, the permissible high rate of flow through valve 95 prevents the development of destructive compression forces within the chamber and allows the establishment of the "back check" condition.

Thus, the structure of valve 95 responds to the force of opening door 24, regardless of whether the door is opened in a normal manner with moderate force or in a violent manner with exceptional force, and allows for the development of sufficient counterforce to establish the "back check" condition.

It is to be noted that chamber 44 forms a first chamber and valve chamber 92 forms a second chamber. Also, flow passage 90 forms a first passage and flow passage 94 forms a second passage. Port 149 and port 140*a* form first and second ports, respectively, and chamber 142 forms a passageway. As noted above, one end of compression spring is positioned in engagement with ball 144 and the other end of the spring is positioned against wall 148 adjacent port 149. When the force of the fluid urges ball 144 away from port 140*a* to compress spring 146, the fluid is allowed to flow from the first passage 90, through second port 140*a*, through the passageway formed by chamber 142, through first port 149 and into second passage 94.

As noted above, the flow rate of the fluid is influenced by the thickness, or the viscosity, of the fluid at the moment of being compressed upon opening of door 24. With the fixed setting of valve 110, the movement of fluid from passage 90*a* into chamber 92*a* is controlled by the fixed constricted space formed by tapered portion 118 of valve 110 and the exit port of passage 90*a*. If the fluid is comparatively thick due to the surrounding temperature, a high compressive force will be required to move the fluid through the constriction, and even then the fluid moves slowly. This results in difficulty in opening the door beyond the sixty to seventy-five degrees position.

If the surrounding temperature is such that the fluid is comparatively thin, a low compressive force is required to move the fluid through the constriction formed by tapered portion 118 and the exit port of passage 90*a* whereby the fluid moves comparatively rapidly. Under these conditions, the door is opened with relative ease beyond the sixty to seventy-five degrees position. This could result in door 24 being opened too quickly which could cause injury or damage as noted above thereby defeating the purpose of valve 110.

With the inventive structure of valve 95, spring 146 continuously maintains ball 144 over port 140*a* to normally preclude the flow of fluid from chamber 44 to reservoir 82. When the fluid is being compressed after the door has reached the sixty to seventy-five degrees opening, the force of the fluid resulting from being compressed overcomes the biasing of spring 146 to some degree. This causes ball 144 to move sufficiently to allow the fluid to move through port 140*a* thereby allowing door 24 to be opened further.

Since the fluid under compression must, in effect, develop its own opening through port 140*a*, the compressing forces as applied in the opening of door 24 will control the size of the opening between ball 144 and port 140*a*. Thus, the thickness, or viscosity, of the fluid has an insignificant, if any, effect on the movement of fluid from chamber 44 to reservoir 82 when valve 95 is used in comparison to the use of valve 110. Thus, spring biased ball 144 tends to offer the same degree of opposition to the opening of door 24 regardless of the thickness, or viscosity, of the fluid. This effectively eliminates concern for, and neutralizes the effects of, wide temperature swings in the environment surrounding door closer 20.

Figure 7:
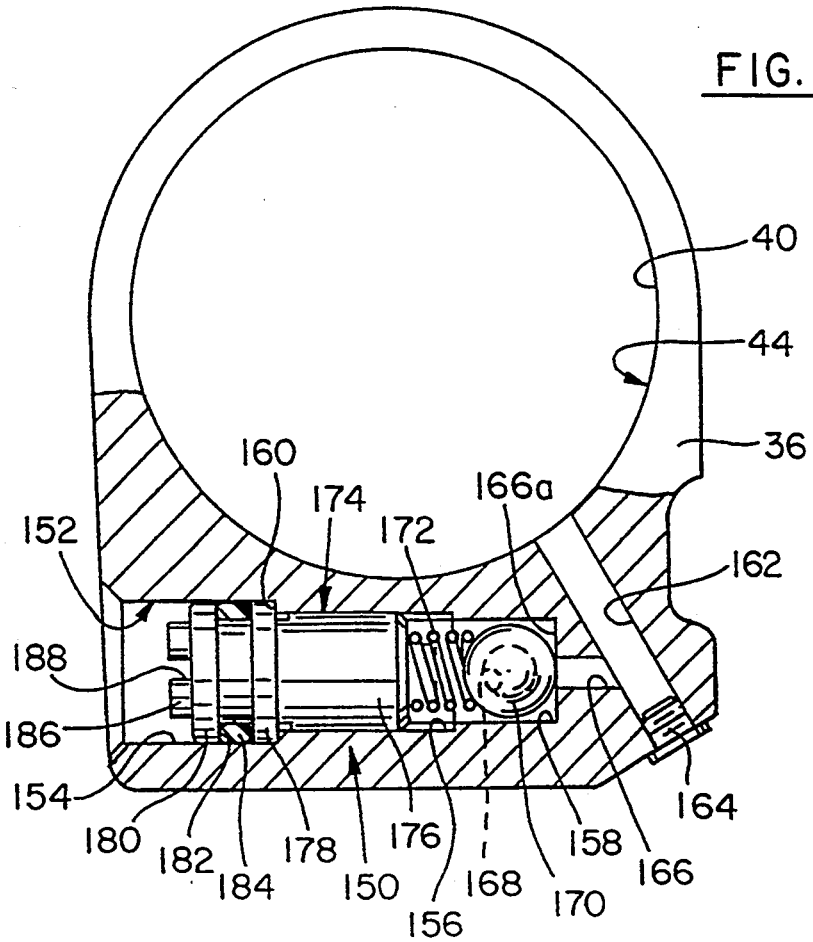
FIG. 7 is a partial sectional view showing an alternative embodiment of a door closer embodying certain principles of the invention.

Referring now to FIG. 7, a back check valve assembly 150 is assembled within a two stepped bore 152 formed in cylinder 36 with the axis of the bore arranged laterally of the longitudinal axis of the cylinder. Bore 152 is formed by three axially aligned bore sections 154, 156 and 158. The diameter of bore section 154 is the largest diameter of sections 154, 156 and 158. In addition, bore section 154 opens to the exterior of cylinder 36. Bore section 158 is the inner most section and has the smallest diameter. Bore section 156 is an intermediate section located between sections 154 and 158 and has a diameter intermediate the diameters of sections 154 and 158. A shoulder 160 is formed at the juncture of bore sections 154 and 156. A passage 162 communicates at one end thereof with chamber 44 of cylinder 36 and has a plug 164 threadedly attached to the other end thereof. Another passage 166 formed in cylinder 36 communicates at one end thereof with passage 162 and with bore section 158 through a port 166*a* at the other end thereof. Another passage 168 communicates with reservoir 82 (not shown in FIG. 7) at one end thereof and with bore section 158 at the other end thereof.

Back check valve assembly 150 further includes a ball 170 which is normally located in bore section 158, a compression spring 172 which is located in bore sections 156 and 158 and a plug 174 which is located in bore sections 154 and 156. Plug 174 is formed with a threaded forward body 176 which is mounted threadedly in bore section 156. Plug 174 is further formed with a pair of spaced annular ribs 178 and 180 to the rear of the forward body with each of the ribs having a diameter approximately the same as the diameter of bore section 154. An annular groove 182 is formed between the ribs 178 and 180 and supports a compliant "O" ring 184. The rearward end of plug 174 is formed with a head 186 and a slot 188 to facilitate the threaded assembly of the plug within bore sections 154 and 156.

Initially, ball 170 is positioned within bore section 158 to effectively cover port 166*a*. Note that the diameter of ball 170 is slightly less than the diameter of bore section 158 so that the ball has sufficient but slight clearance space for freedom of movement within bore section. Also, ball 170 is normally located over the entry port of passage 168. Compression spring 172 is then inserted into the position illustrated within bore sections 156 and 158. Plug 174 is threadedly mounted within bore section 156 until the forward face of annular rib 178 engages shoulder 160 of bore section 154. At this point, plug 174 cannot be inserted any further into bore 152. This establishes the maximum compression force applied by spring 172 against ball 170 thereby establishing the maximum level of force which must be exceeded by the force of the fluid being compressed in chamber 44 to move the ball in the same manner described above with respect to the positioning of valve 95 within chamber 92. Likewise, in the manner described above with respect to valve 95, valve assembly 150, and particularly plug 174, can be adjusted to a desired location within bore 152 which is less than the maximum position whereby spring 172 is relaxed. Under these conditions, less than maximum force is applied by spring 172 against ball 170 and, therefore, the level of fluid force necessary to overcome the relaxed spring force is less than the maximum fluid force in the same manner described above with respect to valve 95.

Ball 170 is pressed against port 166*a* by compression spring 172 to preclude the flow of fluid therethrough. Upon opening of door 24, fluid will flow from chamber 44, through passage 162 and passage 166 to port 166*a* where ball 170 precludes further movement of the fluid until the compressing forces of the fluid are sufficient to overcome the biasing of spring 172. The principle of operation of ball 170 and spring 172 is identical to the principle of operation of ball 144 and spring 146 associated with valve 95 and will be described only to the following extent.

When door 24 reaches the sixty to seventy-five degrees open position, the compressing fluid will cause ball 170 to be moved away from port 166*a* against the biasing action of spring 172. This allows fluid to flow through port 166*a* and into passage 168 and then into reservoir 82 in the same manner described above with respect to valve 95.

Thus, while valve 95 illustrates the preferred embodiment of practicing the invention, valve assembly 150 illustrates an alternative embodiment for practicing the invention.

Figure 8:
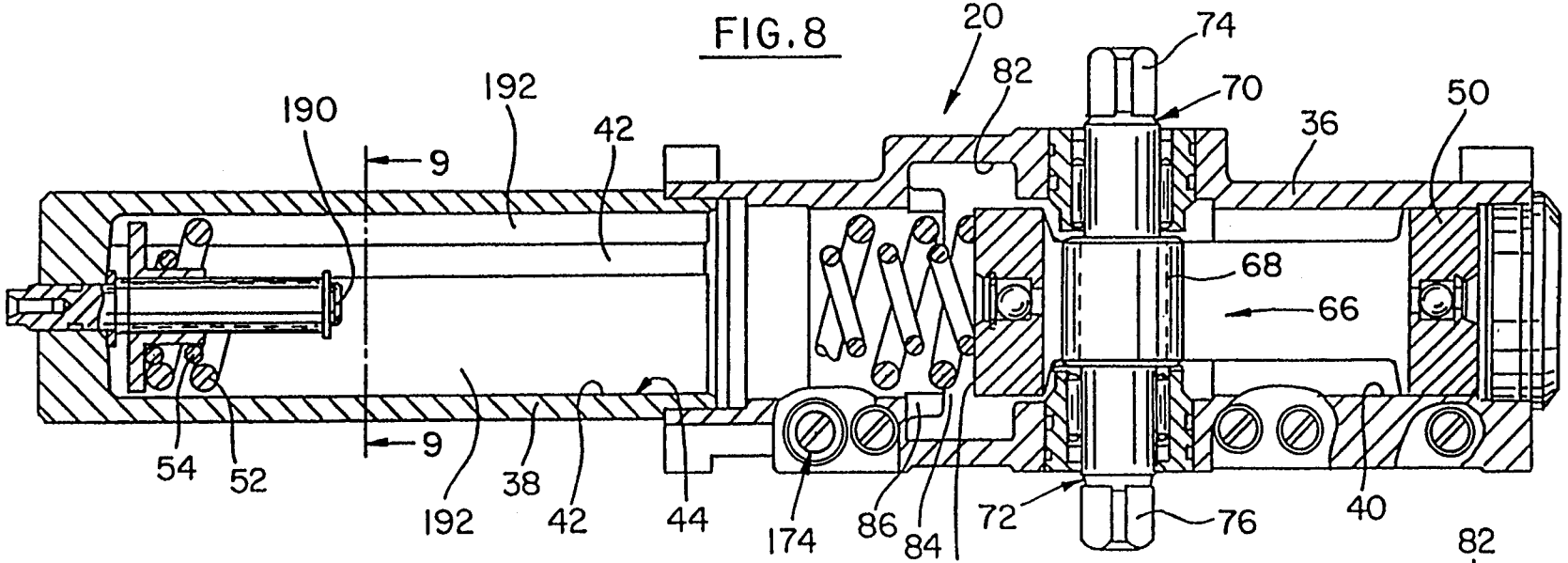
FIG. 8 is an enlarged sectional view of a door closer embodying certain principles of the invention.
Figure 10:
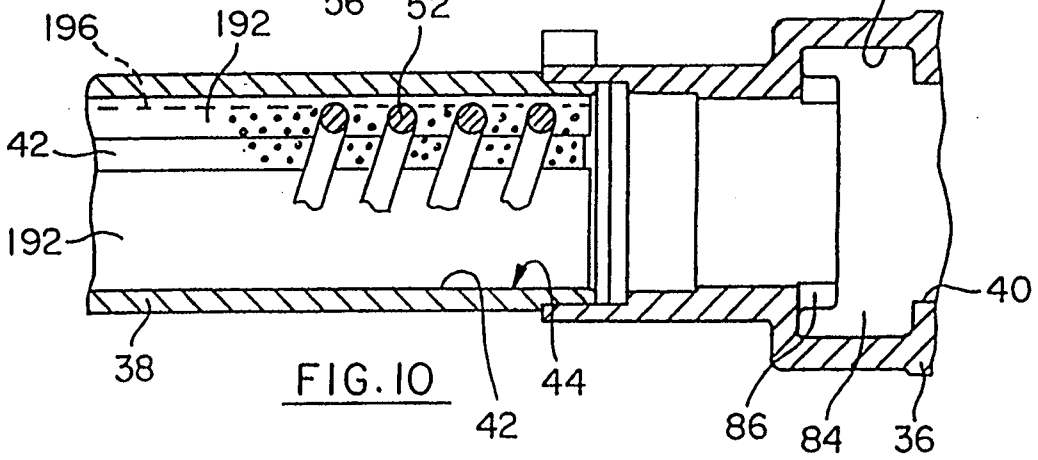
FIG. 10 is a partial sectional view of the door closer of FIG. 8 illustrating certain principles of the invention.
Figure 9:
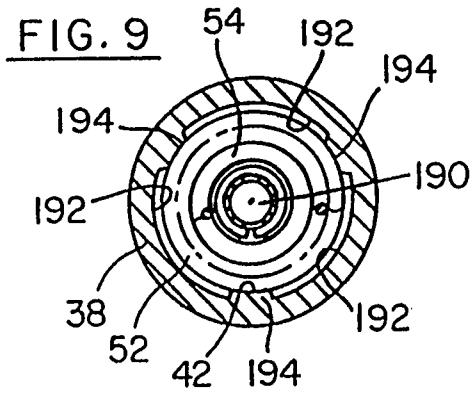
FIG. 9 is a sectional view taken along the line 9—9 of FIG. 8 showing the door closer of FIG. 8 embodying certain principles of the invention.

Referring now to FIGS. 8, 9 and 10, there is illustrated another preferred embodiment of the invention embodied in door closer 20. In particular, where features previously described above with respect to FIGS. 1 through 7 are common to FIGS. 8, 9 and 10, the numbers assigned to those features will be retained in FIGS. 8, 9 and 10.

As shown in FIGS. 8 and 9, a pin 190 is axially located within spring tube 38 and forms a central mounting for springs 52 and 54 at the outbound end of the tube. Typically, larger spring 52 extends radially outwardly to the walls of tube opening 42 which forms a part of chamber 44. It is known that gas, for example, such as air, is captured within the fluid in the form of bubbles. Further, the gas bubbles migrate to the top of tube 38 between upper portions of convolutions of spring 52 to the extent illustrated in FIG. 10.

When fluid is "worked" toward reservoir 82 in the manner described hereinabove, the gas bubbles are trapped between the spaced convolutions of spring 52 and the top potion of spring tube 38 and are not "worked" into reservoir 82. A gas such as air is more readily compressible in comparison to the fluid, such as oil, which is typically used in door closer 20. Thus, when door 24 reaches the sixty to seventy-five degrees open position, it is desirable that the "back check" condition occur wherein it is more difficult to continue opening the door as described above. Normally, this would be accomplished by constricting the flow of fluid as described above while allowing some compressing of the fluid to present a back pressure to the opening of door 24. The ability of the fluid to resist such compressing assists, then, in establishing the "back check" condition.

With the gas bubbles entrapped as described above, some of the compressing forces associated with continued opening of door 24 will be directed to compressing the gas bubbles which have much less resistance to compression than the fluid. Thus, the back pressure necessary to attain the "back check" condition undesirably may not be reached and door 24 may open more freely even though the door is opened beyond the sixty to seventy-five degrees open position. Thus, it is important that the gas bubbles be "worked" from the fluid and into reservoir 82 if the "back check" condition is to be attained at the appropriate door opening. Referring again to FIGS. 8, 9 and 10, the inner wall of tube opening 42 of spring tube 38 has been formed with three wide radial slots 192 which extend from the end of the tube which mates with cylinder 36 toward the opposite or closed end of the tube. The remaining wall of tube opening 42 is unchanged to provide, in effect, three longitudinal ribs 194 which serve to separate slots 192 and to provide confined support for spring 52. The ribs 194 and slots 192 are particularly visible in FIG. 9. As shown in FIG. 10, a dotted line 196 represents the uppermost plane to which spring 52 will extend. The area above dotted line 196, and within opening 42 represents that portion of one of slots 192 which is located above spring 52 which portion is also visible in FIG. 9.

Thus, ribs 194 provide support for and confine the positioning of spring 52 to the extent no portion of the spring will protrude into slots 192. In this manner, portions of the fluid will be located in slots 192 and particularly in the slot which is located at the top of spring tube 38. Now, when the gas bubbles rise naturally to the top of the fluid, the bubbles will extend into the upper slot 192 above the convolutions of spring 52 and are not trapped between the convolutions and the spring tube 38. When fluid is being "worked" from chamber 44 into reservoir 82 by the opening of door 24, the portion of the fluid at the top of tube 38 which includes the entrapped gas bubbles will be "worked" from the chamber into the reservoir. Thus, the gas bubbles are removed from the portion of the fluid which remains in chamber 44 and, therefore, does not affect deleteriously the subsequent compressibility of the fluid within the chamber.

Figure 12:
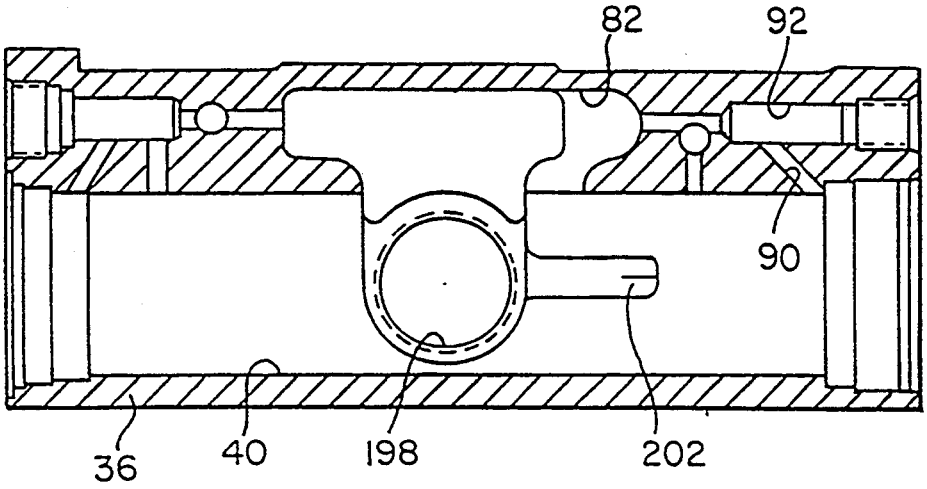
FIG. 12 is a sectional view taken along line 12—12 of FIG. 11 showing the door closer of FIG. 11 embodying certain principles of the invention.
Figure 11:
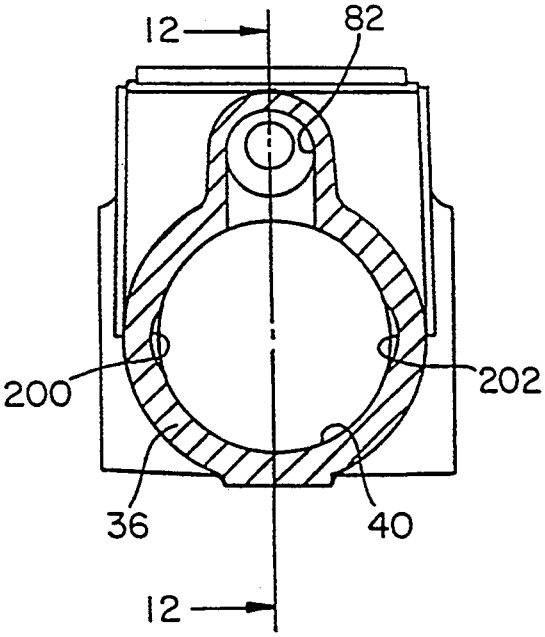
FIG. 11 is a sectional view of a cylinder of a door closer showing still another embodiment embodying certain principles of the invention.

Referring to FIGS. 11 and 12, there is illustrated another embodiment of the invention which is designed to "work" gas bubbles which are entrapped in the fluid from chamber 44 into reservoir 82. In particular, cylinder 36 is illustrated in FIGS. 11 and 12 and reveals structure also illustrated in FIG. 4. Thus, numerals used in FIG. 4 to relate to structure therein will also be used in FIGS. 11 and 12 to relate the same structure therein.

As shown in FIG. 12, a pair of spaced, axially aligned openings 198 (one shown) are formed with internal threads to receive the drive member which includes coupling elements 70 and 72 (FIG. 8). A pair of opposed slots 200 and 202, as shown in FIG. 11, are formed in the wall of inner opening 40 of cylinder 36 and communicate with openings which link slots 200 and 202 with reservoir 82. In this manner, as piston element 50 (FIG. 4) is moved upon opening of door 24, portions of the fluid which has the gas bubbles entrapped therein will be worked into slots 200 and 202 and eventually into reservoir 82. Thereafter, the compressibility of the fluid within chamber 44 presents the necessary and appropriate opposition to the opening of door 24 to establish the "back check" condition.

Thus, the above-described features including back check valve 95 and back check valve assembly 150 provide facilities which enhance the operation of door closer 20 in a unique manner. Further, the features of door closer 20, including slots 192 and slots 200 and 202, which facilitate the "working" of gas bubbles from the fluid, further enhance the operation of the door closer. All of these features can be used individually or in various combinations as illustrated in the drawings and as described above without departing from the spirit and scope of the invention.

The above-described embodiments, of course, are not to be construed as limiting the breadth of the present invention. Modifications, and other alternative constructions, will be apparent which are within the spirit and scope of the invention as defined in the appended claims.

What is claimed is:

1. A door closer, which comprises:

a housing;

a first chamber formed within the housing for containing a fluid therein, the chamber being formed with a first portion and a second portion;

a piston element located normally in the first portion of, and movable within, the first chamber;

means responsive to forces externally of the first chamber for moving the piston element into the second portion of the chamber to initiate compression of the fluid therein;

a second chamber formed in the housing spaced from the second portion of the first chamber;

a first passage formed in the housing in communication with the first chamber and with a first portion of the second chamber;

a second passage formed in the housing in communication with a second portion of the second chamber spaced from the first portion thereof;

a first port formed at a juncture of the second passage and the second chamber; and means located in the second chamber and formed with a passageway located between the first passage and the second passage and responsive to pressure of the fluid being forced into the passageway from the first passage to the second passage for controlling the rate of flow of the fluid through the passageway and, thereby, the rate of permissible movement of the piston element within the first chamber;

the controlling means comprises:

a second port located between the first passage and the passageway;

a blocking element located in the passageway adjacent the second port;

means, located at least partially within the passageway and having a first end in engagement with the blocking element and a second end located in a constrained position about and outside the first port, for normally urging the blocking element into a position to cover the second port and for allowing the blocking element to move away from the second port when subjected to pressure of the fluid being moved from the first chamber into the first passage; and means for adjusting the urging and allowing means to selectively establish a force applied by the urging means against the blocking element.

2. The door closer as set forth in claim 1 wherein the housing comprises:

a cylinder having a cap at one end and being open at the other end;

a tube having a cap at one end and being open at the other end; and the cylinder and the tube being assembled with the open ends thereof in facing relation so that the cylinder and the tube form the chamber.

3. The door closer as set forth in claim 1 which further comprises a reservoir formed in the housing and in communication with at least the second passage to facilitate receipt in the reservoir of the fluid being moved through the passageway.

4. The door closer as set forth in claim 1 wherein the second chamber is formed with a wall in which the first port is formed at the juncture of the second passage and the second chamber, and the second end of the urging and allowing means is resting against and constrained by the wall to preclude movement and locating of the urging and allowing means beyond the first port in a direction away from the second port.

* * * * *